United States Patent [19]

Blackmond

[11] 4,153,824

[45] May 8, 1979

[54] APPLIANCE CONTROL TIMER DRIVE MEANS

[76] Inventor: George O. Blackmond, 3016 Overbrook Dr., Port St. Lucie, Fla. 33452

[21] Appl. No.: 843,518

[22] Filed: Oct. 19, 1977

[51] Int. Cl.[2] ..... H01H 43/00

[52] U.S. Cl. ..... 200/35 R; 200/38 BA

[58] Field of Search ..... 74/125, 575, 577 R, 74/577 S, 577 M, 568 T, 568 M; 200/35 R, 38 R, 38 B, 38 BA, 38 C, 38 CA

[56] References Cited

U.S. PATENT DOCUMENTS

| | | | |
|---|---|---|---|
| 2,803,715 | 8/1957 | Guth | 200/38 C |
| 3,110,776 | 11/1963 | Hogan et al. | 200/38 BA |
| 3,857,293 | 12/1974 | Godwin et al. | 74/568 T |

*Primary Examiner*—James R. Scott
*Attorney, Agent, or Firm*—Carroll F. Palmer

[57] ABSTRACT

The rotary control timer for an automatic appliance, e.g., a washing machine, is driven by connecting a saddle pawl through a cable or equivalent connector to an element in the appliance that continually oscillates or makes other repeated cycles of movement of substantially constant time duration during operation of the appliance. Prongs on the pawl engage a plurality of peripherally toothed wheels, one of which is connected to the timer cam drum and another of which is free to rotate relative to the cam drum in such manner that a pawl prong continually engages the free rotation wheel while a second pawl prong engages the drum connected wheel only intermittently.

10 Claims, 10 Drawing Figures

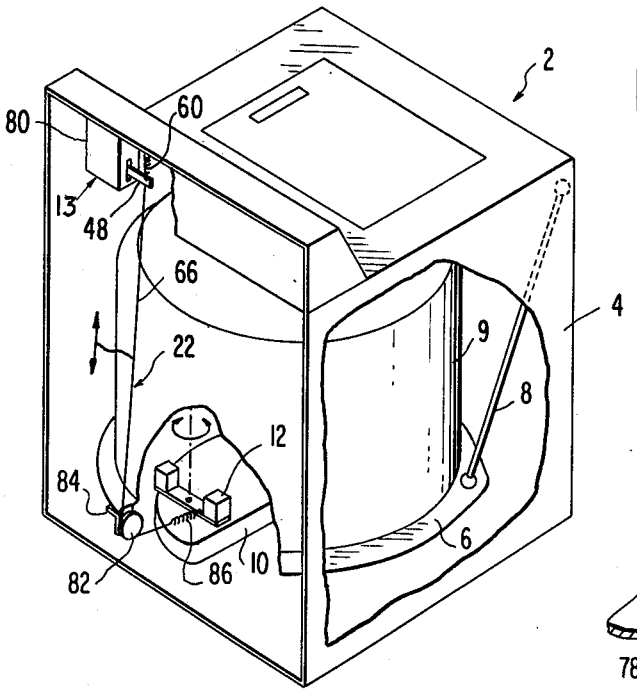
FIG. 1
FIG. 2
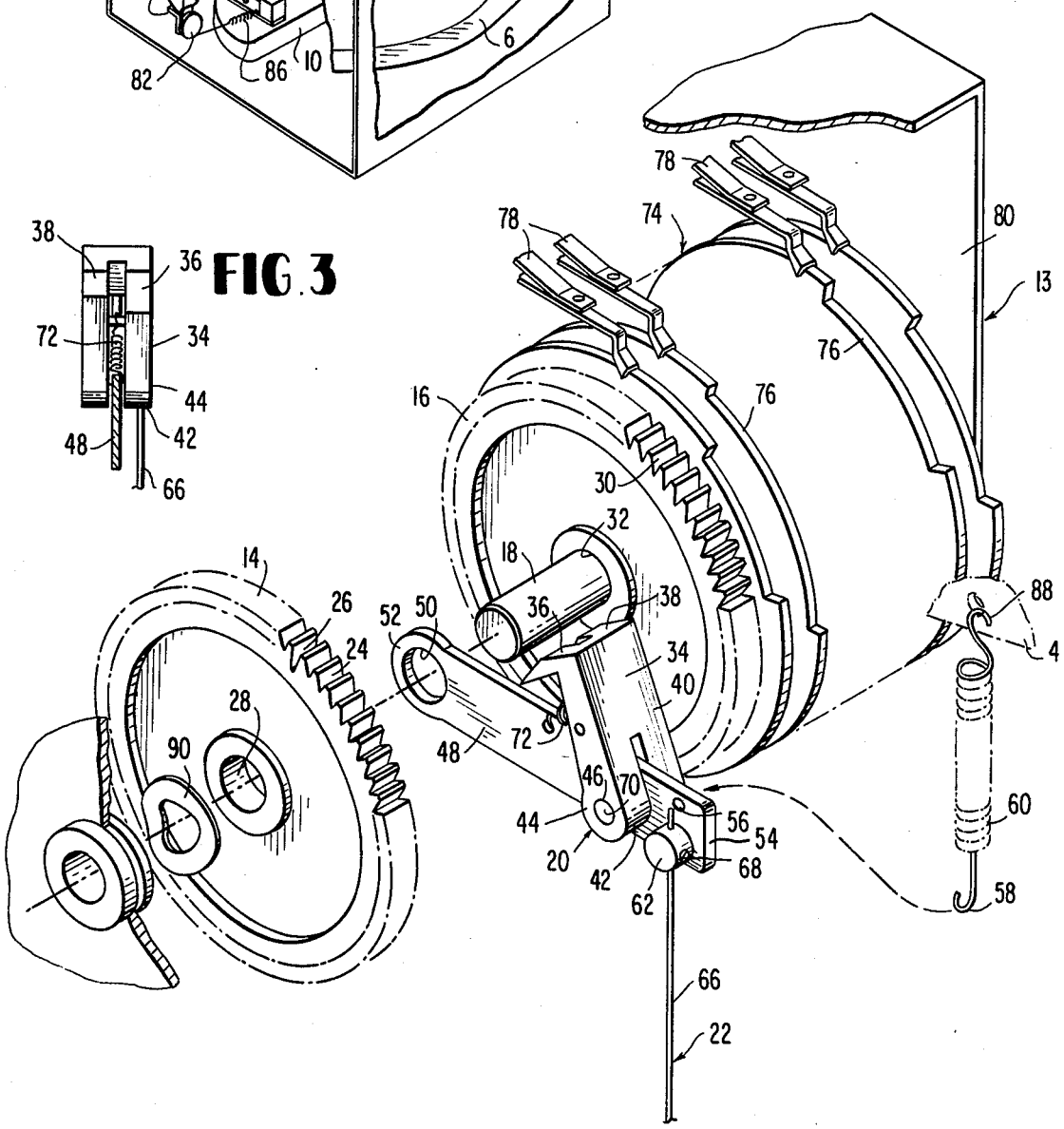
FIG. 3

FIG. 4A
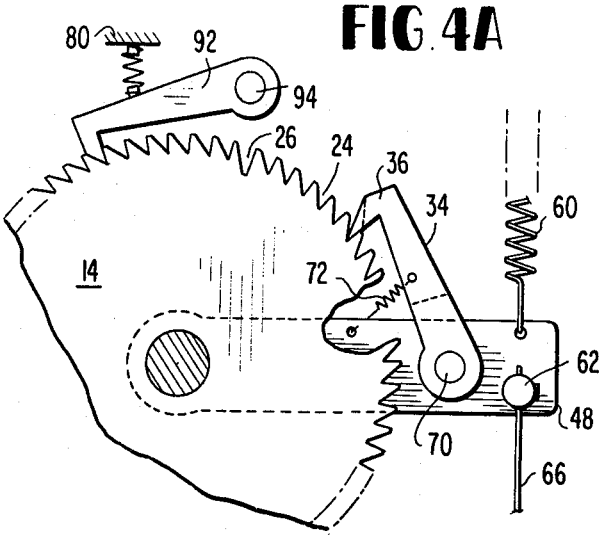
FIG. 4B
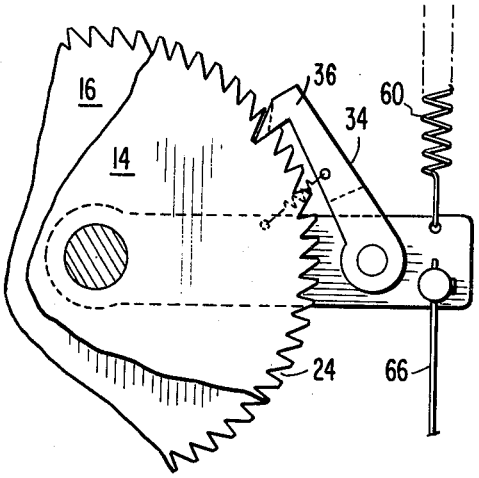
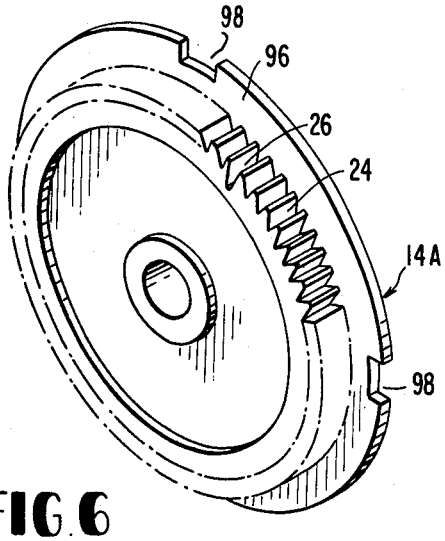
FIG. 6
FIG. 5A
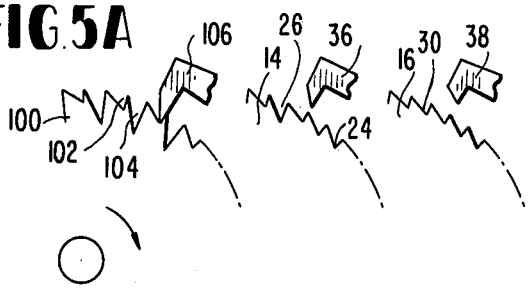
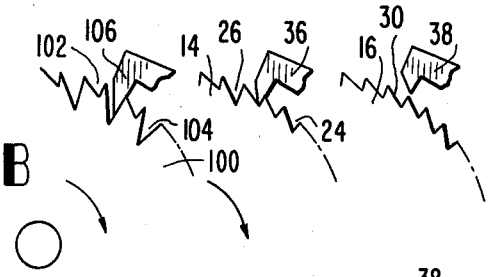
FIG. 5B
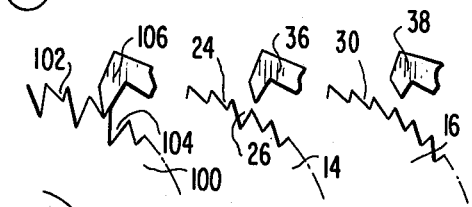
FIG. 5C
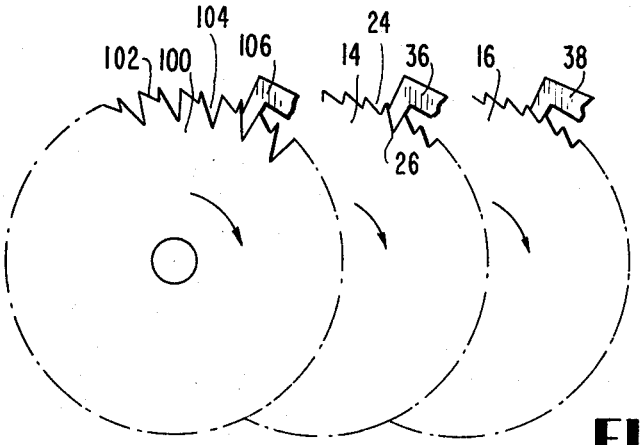
FIG. 5D

APPLIANCE CONTROL TIMER DRIVE MEANS

BACKGROUND OF THE INVENTION

1. Field of the Invention

This invention relates broadly to means to drive an automatic appliance control timer. More particularly, it concerns means by which a rotary control timer for an automatic appliance can be operated from power derived from the main power unit of the appliance as opposed to use of a separate motor for operation of the control timer. The invention is uniquely suited for use with automatic clothes washing machines and the following description of it concentrates on this application.

2. Description of the Prior Art

Automatic appliances, e.g., washing machines, clothes driers, etc. in which the operation of the appliance through various performance steps, e.g., washing, rinsing, water extraction, etc., is controlled by rotary control devices that operate electrical switches to energize solenoids or other units in the appliance have been developed to a high degree of performance and capability. Steady, timed rotation of the rotary control devices is typically performed by a small electric motor comprising an integral part of the control device.

Most automatic washing machine units are suspended from a fixed frame to allow the working elements to float freely in a horizontal motion during operation. Although power has been available in the machine unit by which it would be possible to drive a rotary timer control device and thereby eliminate the added expense of a separate motor for the control device, this has been avoided by the prior art because it has been thought that the erratic horizontal motion of the machine unit would produce unreliable timing in the control device. Nevertheless, if the control device can be driven in a reliable manner indirectly by the main motor that powers the operation of the washing machine, substantial savings in the cost of manufacture of the control device and, in turn, the appliance can be attained.

OBJECTS

A principal object of this invention is the provision of improvements in appliance control timer devices. Further objects include the provision of:

1. A mechanical timer control for an automatic appliance driven by power from the motor that operates the appliance.

2. A new concept for the powering of appliance control timer devices.

3. Means for eliminating the need for a separate motor to power an appliance control timer device.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished according to the present invention through two basic means, namely, the steady transmission of periodic mechanical force from an unstable platform to a stable platform and the use of multiple indexing wheels in combination with multiple pronged pawls to advance a control timer drum at a rate slower than the repetition period of the mechanical force from the unstable platform.

The control drive means of the invention is used with an automatic appliance, e.g., washing machine, that has a rotary timer for control of the operations of the appliance, a motor that powers operation of the appliance and an element within the appliance that is driven, directly or indirectly, by the motor through repeated cycles of movement of substantially constant time duration, e.g., periodic oscillations. Such control device basically comprises:

a first wheel having a series of peripheral teeth substantially equidistantally spaced, at least one of the teeth being of greater depth than the substantially uniform depth of the remaining teeth, a second wheel having a series of peripheral teeth substantially equidistantally spaced equivalent to the spacing of the teeth of the first wheel, a shaft upon which the wheels are rotatably mounted adjacent each other, pawl means fulcrumed upon the shaft for rocking motion, the means comprising first and second prongs spaced apart approximately the distance between the first and second wheels, spring means biasing said pawl means toward the wheels for contact of the first and second prongs with the peripheries of the first and second wheels respectively, and connector means extending between the pawl means and the aforesaid motor driven element in the appliance to pull the pawl means through a rocking motion in unison with the cyclic movement of the element.

The connector means may be a rod, wire, cable, monofilament or like element and may include one or more pulleys, fairleads or the like for directional changes thereof.

Where the periodic motion from the unstable platform would be very rapid, the new control device may slow down the motion by using a third wheel having a series of peripheral teeth substantially equidistantally spaced equivalent to the spacing of the teeth of the first wheel. A plurality of the third wheel teeth have a depth intermediate the depth of the greater and lesser depth teeth of the first wheel while the remaining teeth of the third wheel have a depth greater than the depth of the deepest tooth of the first wheel. The third wheel is rotationally mounted upon the shaft adjacent the first wheel and the pawl means will have a third prong spaced apart from the first prong approximately the distance between the first and third wheels. The third prong engages the teeth in the third wheel to turn it at a rate different than the first and second wheels.

In most automatic washing machines, the machine unit, comprising a gear case, tub, basket and motor, is suspended from a fixed frame to allow the machine unit to float freely in a horizontal motion during the washing and spin-drying cycles. The present invention is based, in part, on the discovery that, although the machine unit moves from side to side and in a circular fashion in erratic manner, it is possible to transmit a substantially constant periodic mechanical force from the machine unit to a stationary control timer carried upon the cabinet for the machine. Hence, movement transmitted vertically from the swaying machine unit can provide an up and down motion to actuate a timer lever. For example, an oscillation motion present in the machine unit when transmitted therefrom horizontally and then projected vertically as a reciprocating motion to the top of the machine cabinet by connector means will not have any horizontal movement and will be reliably constant in reciprocation period.

A lever with its fulcrum on the timer-drum shaft and limited in its up and down movement is used to actuate a double pronged pawl. This pawl will advance the first toothed wheel located on the same timer shaft. This wheel which is the same diameter as the second one on the timer drum will advance one tooth for each stroke of the lever and pawl attached thereto. One tooth on the first wheel has a depth approximately three times deeper than the remaining teeth. The actuating pawl has two prongs side by side with the prong over the first wheel being about three times longer than the prong over the second wheel. The longer prong as it bottoms in each tooth of the first wheel will allow the shorter prong above the second wheel to ride freely above that wheel until the deep tooth on the first wheel is reached. At that time both prongs will drop into the teeth of their respective wheels and the pawl will advance both wheels one segment thus advancing the timer drum connected to the second wheel one increment. After the required number of increments, the washing, rinsing and drying is completed and the appliance shuts off.

BRIEF DESCRIPTION OF THE DRAWINGS

A more complete understanding of the timer drive means of the invention may be obtained by reference to the accompanying drawings in which:

FIG. 1 is a fragmentary, perspective view of a washing machine equipped with a control timer driven in accordance with this invention.

FIG. 2 is a fragmented, exploded view of a portion of a timer drive means of the invention adjacent a typical prior art timer control drum.

FIG. 3 is an axial view of pawl means forming a part of the timer drive means as shown in FIG. 2.

FIG. 4A is a fragmentary, lateral view of a portion of a time drive means of the invention.

FIG. 4B is a fragmentary, lateral view corresponding to FIG. 4A showing the drive means in another stage of its operation.

FIGS. 5A–5D are fragmentary, exploded views of a three wheel modification of the invention illustrating various stages of its operation.

FIG. 6 is an isometric view of a modified form of toothed wheel forming a part of the drive means of the invention.

DESCRIPTION OF THE PREFERRED EMBODIMENTS

Referring in detail to the drawings, the washing machine 2 comprises a cabinet 4, platform 6 supported within the cabinet 4 by struts 8 which carries the tub 9. A gear casing 10 from which the wig-wag 12 extends is bolted to the platform 6. All of these items are conventional in the prior art and form the appliance for which the present invention provides improvements.

The cabinet 4 encloses frame members (not specifically shown) by which the machine units 6, 9 and 10 are suspended by struts 8 (usually three in number) to allow the machine units to float freely in a horizontal motion during the washing and other programmed cycles of the washing machine 2. The gear case 10 during the machine operation will move from side to side and also in a circular motion, i.e., its movement is complex and erratic. The wig-wag 12 is a solenoid control unit for a cam-bar drive unit (not shown) in the washing machine. It is carried on a vertical shaft that extends out from the gear case 10 and during operation of the washer 2, oscillates as indicated by the arrows through an arc of about 60°. Hence, the wig-wag 12 constitutes a member which during the operation of machine 2 has repeated cycles of movement of substantially constant time duration.

A washing machine 2 comprising parts as just described also conventionally includes a timer device that controls the operation cycles of the machine. Typically, such timers are driven at a constant rate by a small electric motor that forms an integral part of the timer device. The present invention provides drive means for such timers without need for a separate electric motor.

A control timer 13 of the invention comprises a first wheel 14, a second wheel 16, a shaft 18 upon which the wheels 14 and 16 are rotatably mounted adjacent each other, pawl means 20 and connector means 22 between said pawl means 20 and the wig-wag 12.

The first wheel 14 has a series of peripheral teeth 24 substantially equidistantally spaced, with at least one tooth 26 being of a greater depth than the substantially uniform depth of the remaining teeth 24. There is a central bore 28 through the wheel 14 sized to revolve smoothly on the shaft 18.

The second wheel 16 has a series of peripheral teeth 30 substantially equidistantally spaced equivalent to the spacing of teeth 24 of wheel 14. The teeth 30 are substantially equal in depth to teeth 24, i.e., they have a lesser depth than tooth 26. The wheel 16 has a bore 32 to fix the wheel 16 on the shaft 18.

The wheels 14 and 16 may be formed of metal, plastic, fiber-reinforced resin or the like and may be fabricated in any suitable manner, e.g., milling, coating, molding, etc. Preferably, they are formed by injection molding of high impact plastic such as nylon.

The pawl means 20 comprises the saddle pawl 34 having a first prong 36, a second prong 38 and a body portion 40 provided at the end 42 with a boss 44 having a bore 46.

The pawl means 20 further comprises a lever arm 48 having a bore 50 in end 52 to journal arm 48 on the shaft 18 between the wheels 14 and 16. The opposite end 54 of arm 48 has a hole 56 which receives the hook-end 58 of spring 60. The cable coupling 62 is also fixed in the end 54 of arm 48. The coupling 62 receives the top end of the cable 66 forming a part of the connector means 22. The coupling 62 is provided with set-screw 68 to permit longitudinal adjustment of cable 66 relative to coupling 62.

The saddle pawl 34 is pivoted on the lever arm 48 by a pin 70 that extends through bore 46 and a corresponding hole (not shown) in arm 48.

A tension spring 72 stretches between the arm 48 and the pawl portion 40 to bias the pawl 34 towards the wheels 14 and 16 for contact of the prongs 36 and 38 with the teeth 24, 26 and teeth 30 in the manner described hereinafter.

The control timer includes a timer drum 74 fixed on the shaft 18 comprising a plurality of notched segments 76 which function with the electrical switch elements 78 to perform the control operation of the timer 13. The elements 74–78 are conventional in washing machine timers and, but for the present invention, are driven by a small integral electric motor (not shown).

The timer 13 is enclosed in a housing 80 fixed inside the cabinet 4. The lever arm 48 extends at its end 54 through the housing 80 permitting the cable 66 to depend from the arm 48 outside the housing 80, but inside the cabinet 4. A pulley 82 is rotated on a bracket on a bracket 84 near the rear fixed to the platform 6 so that the cable 66 may pass around sheave 82 horizontally toward wig-wag 12 and vertically, outside the platform 6 and tub 9, to the control 13. A spring 86 joins the cable 66 to the wig-wag 12. The spring 60 is hooked at end 88 to the cabinet 4 biasing arm 48 upwardly, but spring 60 is less strong than spring 86, e.g., 1 lb. vs. 2 lb., so that cable 66 will move, except in emergency situations, in unison with spring 86, which being fixed at one end to wig-wag 12, will, in turn, move in unison with wig-wag 12. As a result the uniform, periodic oscillations of wig-wag 12 are converted by connector means 22 into steady reciprocating movements to move the lever arm 48 in a rocking motion identical in phase to the oscillations of wig-wag 12. The movements of lever arm 48 in turn cause the saddle pawl 34 to reciprocate. With each reciprocation, the prong 36 will engage one of the teeth 24 of wheel 14, but the prong 38, being shorter than prong 36, will not engage teeth 30 of wheel 16. On return of the pawl 34 toward its apogee, the prong 36 will ramp up the next succeeding tooth 24 of wheel 14, then engage the tooth (see FIG. 4A) and advance the wheel 14 one increment as the pawl 34 descends with the lever arm 48. This operation continues until the prong 36 engages the deep tooth 26 on wheel 14 at which time prong 38 will engage a tooth 30 of wheel 16 and wheel 16 will advance one increment with wheel 14 (see FIG. 4B). On the next reciprocation, the prong 36 will again engage a short tooth 24 on wheel 14 and prong 38 will remain out of contact of wheel 16 until tooth 26 is again entered by prong 36. In this manner, wheel 16 is advanced one tooth increment for each revolution of wheel 14. Obviously, the number and size of the teeth on the wheels may be varied to obtain different timing output for the timer drive means of this invention. Also, the wheel 14 may be provided with two or more deep teeth 26 so that wheel 16 will advance two or more increments for each revolution of the wheel 14.

The timer drum 74 is connected to the wheel 16 so that the two rotate together as a unit. Hence, one rotation of the wheel 16 will move the timer through the complete time cycle. Since wheel 14 is free to rotate by itself, means are provided to prevent it from regressing as the prong 36 ramps up the teeth with each stroke of the pawl 34. This can be a wave or compression washer 90 (see FIG. 2) or a spring-biased pawl 92 (see FIG. 4A) pivoted on pin 94 carried by the timer housing 80. A leaf spring (not shown) can be used in place of pawl 92.

In order to provide special timing features in time intervals of shorter duration than can be practically obtained with the relatively slow moving drum 74, e.g., short spurts of rinse water, a modified form of wheel 14A as shown in FIG. 6 may be used. Such wheel has the short teeth 24 and long tooth 26 and moves the same as wheel 14. However, an integral flange 96 is provided on one side of the wheel 14A and this has a plurality of notches 98 formed therein. Electric switch elements (not shown), such as elements 78 of FIG. 2, may ride on the flange 96 and as the wheel 14A rotates, the switch will be activated each time it engages one of the notches 98. Such switch would, in turn, be activated only for a measured time by series connection with an element 78 controlled by the drum 74. The notches 98 would be sized and spaced so that the frequency and length of activation of the switch element riding on flange 96 would provide the desired short time function.

The time interval for one complete rotation of the drum drive wheel 16 can be further extended by use of a three wheel drive unit as illustrated in FIGS. 5A–5D. In this modification, the drive unit includes a third, toothed wheel 100, in addition to wheels 14 and 16. The wheel 14 has teeth 24 and 26 and the wheel 16 has teeth 30 as previously described. Wheel 100 has shallow teeth 102 and alternating therewith, deep teeth 104. Also, the saddle pawl in this modification has, in addition to prongs 36 and 38, a prong 106. As seen in FIG. 5A, when the prong 106 enters a shallow tooth 102, prongs 36 and 38 will be out of contact with wheels 14 and 16. On the next stroke of the saddle pawl (see FIG. 5B), the prong 106 enters a deep tooth 104 permitting prong 36 to seat in a shallow tooth 24 of wheel 14, but prong 38 will still ride free of wheel 16. On the next stroke of the pawl (see FIG. 5C) the prong 106 will again seat on a shallow tooth 102 and prongs 36 and 38 will ride free of the wheels 14 and 16. This operation will continue until the wheels rotate to the point where prong 36 enters the deep tooth 26 of wheel 14 (see FIG. 5D). At that time, all of the prongs 36, 38, and 106 will engage and seat in their respective wheels 14, 16 and 100 and all three wheels will advance one increment. Hence, wheel 100 will make two revolutions for each one of wheel 14 and wheel 16 will move one increment for each revolution of wheel 14. Wheel 100 will move one increment for each stroke of the pawl and lever arm 48 and wheel 14 one increment for each two strokes. Hence, the time lapse for rotation of timer drum 74 is doubled as compared to the arrangement shown in FIG. 2. Other tooth 102 and 104 combinations can be used to provide other time intervals, e.g., triple, quadruple, etc. For example, the teeth 102 and 104 can be intermediate in depth relative to teeth 24 and 26 of wheel 14 and the prong 106 can be intermediate in length to prongs 36 and 38. Such an arrangement will provide a doubling of the time cycle, but unlike the three wheel construction shown in FIGS. 5A–5D, wheel 100 will turn slower than wheel 14, but faster than wheel 16.

Instead of using a cable 66 for the connector means 22, a wire, monofilament, thread, etc., can be used or a cable with fixed sheath may be used in place of the cable 66 and pulley arrangement. Also, other modifications will be apparent to those skilled in the art, e.g., leaf-springs in place of coil springs. Likewise, the new drive means may be used with other known timer devices than the drum type as illustrated.

The embodiments of the invention in which an exclusive property or privilege is claimed are defined as follows:

1. In an automatic appliance having a rotary timer for control of operations performed by the appliance, a motor that powers the operation of the appliance and an element driven by said motor during operation of the appliance through repeated cycles of movement of substantially constant time duration, the improvement for powering said rotary timer which comprises:

a first wheel having a series of peripheral teeth substantially equidistantally spaced, at least one of said teeth being of greater depth than the substantially uniform depth of the remaining teeth, a second wheel having a series of peripheral teeth substantially equidistantally spaced equivalent to the spacing of the teeth of said first wheel and having a depth substantially equal to the depth of said remaining teeth, a shaft upon which said wheels are rotatably mounted adjacent each other, said first wheel being freely rotatable on said shaft and said second wheel being rigidly mounted to said shaft, pawl means carried upon said shaft for rocking motion, said means comprising first and second prongs spaced apart approximately the distance between said first and second wheels, spring means biasing said pawl means toward said wheels for contact of said first and second prongs with the peripheries of said first and second wheels respectively, and connector means extending between said pawl means and said motor driven element to pull said pawl means through a rocking motion in unison with the cyclic movement of said element.

2. The appliance of claim 1 wherein said first prong of said pawl means is longer than said second prong.

3. The appliance of claim 2 wherein said connector means comprises a cable and a pulley around which said cable runs carried upon a portion of the appliance.

4. The appliance of claim 3 wherein said pawl means comprises a lever arm having a bore at one end through which said shaft extends to pivot the lever arm between said first and second wheels, a saddle pawl mounted on said lever arm for reciprocating movement relative to the lever arm and spring means biasing said saddle pawl toward said lever arm.

5. The appliance of claim 4 wherein said connector means further comprises a spring biasing said pawl means against the pull of said cable.

6. The appliance of claim 1 wherein said appliance is a washing machine in which the clothes basket rotates about a vertical axis.

7. The appliance of claim 6 wherein said motor driven element is a solenoid drive control element that oscillates in a horizontal plane within the appliance during operation thereof.

8. The appliance of claim 7 wherein said solenoid drive control element is fixed to a shaft that extends from a gear case and which causes the control element to oscillate.

9. The appliance of claim 1 wherein said improvement comprises a third wheel having a series of peripheral teeth substantially equidistantally spaced equivalent to the spacing of the teeth of said first wheel, a plurality of the third wheel teeth having a depth intermediate the depth of the greater and lesser depth teeth of said first wheel and the other teeth having a greater depth than said greater depth teeth, said third wheel being freely rotationally mounted upon said shaft adjacent said first wheel and said pawl means comprises a third prong spaced apart from said first prong approximately the distance between said first and third wheels, said third prong having a length greater than the length of said first and second prongs.

10. The appliance of claim 9 wherein said first wheel has only one tooth of said greater depth and each alternate tooth of said third wheel is of said intermediate depth.

* * * * *